US006457415B1

(12) United States Patent
Peter Sung Yan

(10) Patent No.: US 6,457,415 B1
(45) Date of Patent: Oct. 1, 2002

(54) FIREWORKS STAND

(75) Inventor: Yu Peter Sung Yan, Florence, AL (US)

(73) Assignee: American Promotional Events, Inc., Florence, AL (US)

( * ) Notice: Subject to any disclaimer, the term of this patent is extended or adjusted under 35 U.S.C. 154(b) by 0 days.

(21) Appl. No.: 09/669,761

(22) Filed: Sep. 26, 2000

(51) Int. Cl.[7] ..... F42B 4/02
(52) U.S. Cl. ..... 102/361
(58) Field of Search ..... 102/361

(56) References Cited

U.S. PATENT DOCUMENTS

| | | | | | |
|---|---|---|---|---|---|
| 1,666,598 | A | | 4/1928 | Hitt | 102/336 |
| 1,761,820 | A | * | 6/1930 | Fabrizio | 102/361 X |
| 2,053,454 | A | | 9/1936 | Whiteside | 278/174 |
| 3,280,744 | A | | 10/1966 | Brown | 102/358 |
| 3,719,147 | A | | 3/1973 | Toporek | 102/37.8 |
| 4,566,388 | A | * | 1/1986 | Loyd, Jr. | 102/361 |
| 5,249,528 | A | * | 10/1993 | Lee | 102/361 |
| 5,339,741 | A | * | 8/1994 | Craven et al. | 102/361 |
| 5,343,808 | A | * | 9/1994 | Collar | 102/361 |
| 5,429,053 | A | * | 7/1995 | Walker | 102/361 |
| 5,979,329 | A | * | 11/1999 | Collar | 102/361 |

FOREIGN PATENT DOCUMENTS

| | | | | |
|---|---|---|---|---|
| DE | 2241934 | * | 3/1973 | 102/361 |
| GB | 2227816 | * | 8/1990 | 102/361 |
| JP | 0127200 | * | 10/1981 | 102/361 |

* cited by examiner

*Primary Examiner*—Peter A. Nelson
(74) *Attorney, Agent, or Firm*—Blackwell Sanders Peper Martin LLP

(57) ABSTRACT

A launching device for launching multiple aerial fireworks in succession from the launching device has a tubular member having a wall defining an internal perimeter sized and shaped to receive conventional aerial fireworks shells. A unitary base is mountable to the tubular member to thereby support the tubular member in an upright use position on a support surface. The base includes a lower portion of appropriate size and shape to support the tubular member in a stable upright position; and a protrusion extends from the lower portion. The protrusion has an outer perimeter corresponding in size and shape to the inner perimeter of the tubular member to thereby permit snug insertion of the protrusion into the tubular member to secure it to the base.

20 Claims, 3 Drawing Sheets

FIREWORKS STAND

BACKGROUND AND SUMMARY OF THE INVENTION

1. Field of the Invention

The present invention relates to the field of fireworks, and more particularly to a multiple use fireworks launching device for launching aerial fireworks shells.

2. Background of the Invention

Tubular structures, commonly referred to as "stands," are known for use in launching the type of aerial fireworks known as shells. Each shell contains an explosive charge which, when detonated, propels the shell out of the launch tube and into the air. The shell then explodes, creating a colorful aerial display. Previously, each individual shell was sold prepackaged with its own launch tube. This method of selling the product proved to be expensive for the manufacturer, who had to make a greater number of shipments and spend more on packaging than would have been required if multiple shells were sold with each launch tube. The known procedure was also inconvenient for the retailer and the customer, who had to contend with a large number of bulky launch tubes. Manufacturers began to ship multiple shells with each tube so that a single launch tube could be reused, however the tubes were generally manufactured of paper or similar material such that each could only withstand a minimal number of launches before the tube was destroyed.

Later, as the aerial fireworks shells grew in popularity, manufacturers began selling packages of shells separately from the launch tubes. Persons wishing to launch a large number of shells required multiple launch tubes because of the fragile nature of the launch tubes that existed at the time. For this reason, it has become desirable to provide a device suitable for use in launching a significant number of shells (for example, about ten or twelve) without the launching device being seriously damaged or effectively destroyed.

Previous attempts have been made to accomplish this goal by constructing launch tubes of polyvinyl chloride ("PVC") and then mounting the tube on a base made of plastic or a synthetic resin. Examples of such known devices include U.S. Pat. No. 3,280,744, issued to Brown, and U.S. Pat. No. 5,979,329, issued to Collar. Due to the heat involved in launching shells some known devices have not proven to be optimal. The heat from the shell launch often melts the PVC and sometimes the base of known launching devices. Thus, even though a known device may be resistant to the explosive force of the detonation of the fireworks shell, it may not be resistant to the heat produced by the explosion. Once the base or tube of such a known device begins to melt, the launching device may no longer contain an airtight seal. Thus, melting of the base reduces the pressure built up in the launch tube as a result of the detonation of the shell, thereby reducing the force available to launch the shell and decreasing the useful life of the launcher.

With the above shortcomings of the known art in mind, the present device has been developed. The new fireworks launching device includes a launch tube and an improved supporting base portion. The base portion is constructed of a heat resistant material, such as rubber, and has a protrusion that extends upwardly from the base and into the launch tube. The protrusion prevents premature breakdown of the base due to the heat produced during detonation of aerial fireworks. Further, the protrusion has an annular ridge that fits snugly against the interior wall of the launch tube, thereby creating a seal. This seal prevents pressure from the explosion of the firework from being lost through or around the base, and the extra force created by that pressure is thus available to better propel the firework into the air.

Thus, it is among the several objects of the invention to provide an aerial fireworks launching device constructed of readily available and inexpensive materials, such as rubber and cardboard, for example, which device is capable of repetitive use without being destroyed, and which does not result in a less than satisfactory aerial display due to the loss of force available to propel the shell upwardly.

It is a further object of the invention to provide a fireworks launching device having the features noted above, which is of simple construction, and is easy for the consumer to safely use.

Accordingly, in furtherance of the above objects, the present invention is, briefly, a launching device for launching multiple aerial fireworks in succession from a common launch tube. The device includes an improved base constructed of a heat-resistant material and having a lower portion of sufficient width and depth to provide stable upright support for a tubular member during use of the device. The base also includes a protrusion which fits slidingly into the tubular member and thereby secures the tubular member to the base. The protrusion has an annular ridge extending radially from its surface, which annular ridge forms a seal against the interior wall of the tubular member, to thereby provide optional usable pressure for the purpose of propelling an aerial firework shell into the air.

These and other advantageous features of the present invention will be in part apparent and in part pointed out herein below.

BRIEF DESCRIPTION OF THE DRAWINGS

Throughout the figures, like parts will be indicated by like element numbers.

DESCRIPTION OF THE PREFERRED EMBODIMENTS

Figure 1:
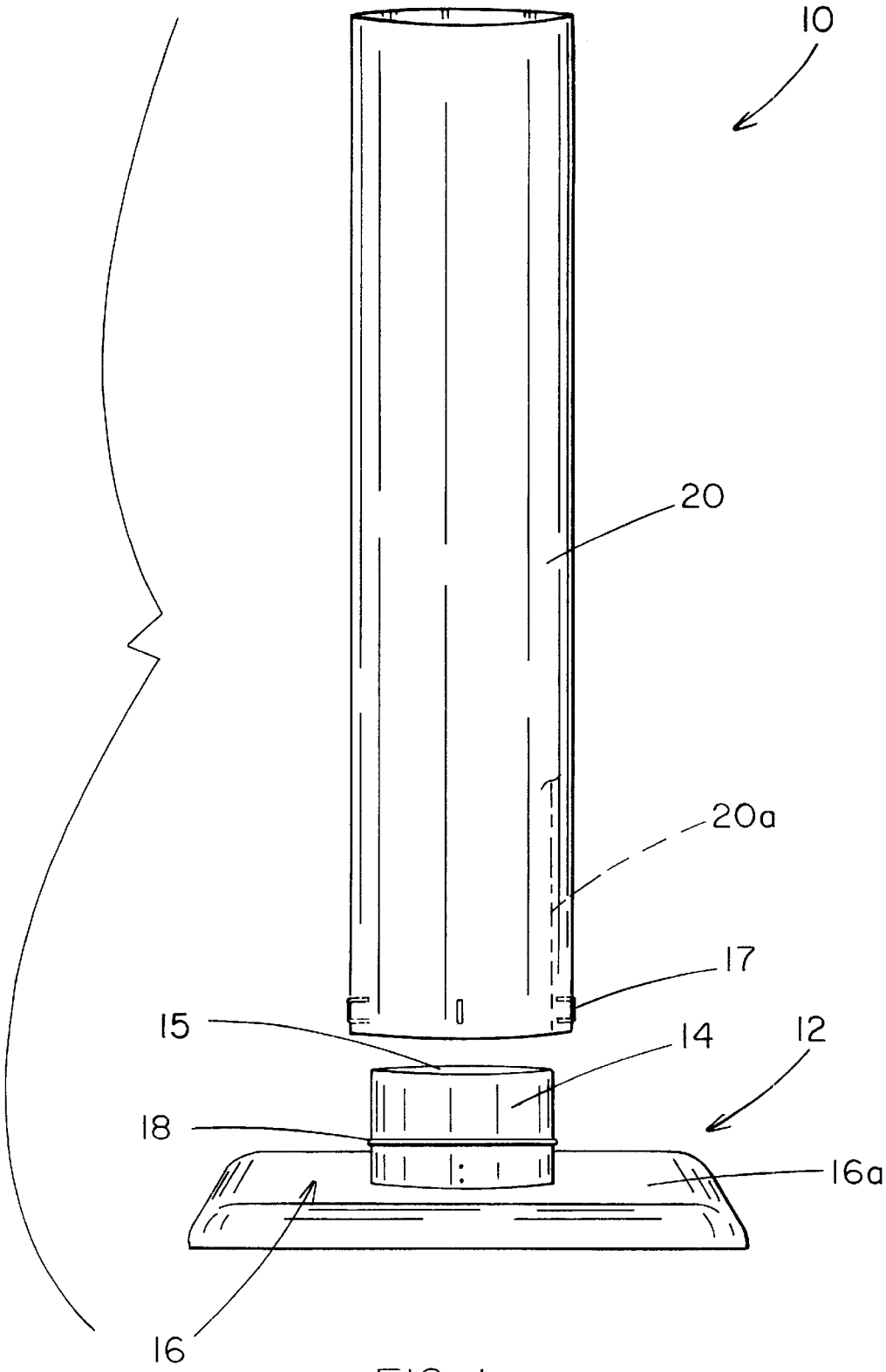
FIG. 1 is an exploded perspective view of the fireworks stand of the present invention with the launch tube disposed vertically above the base to show the structure of the base plug.
Figure 2:
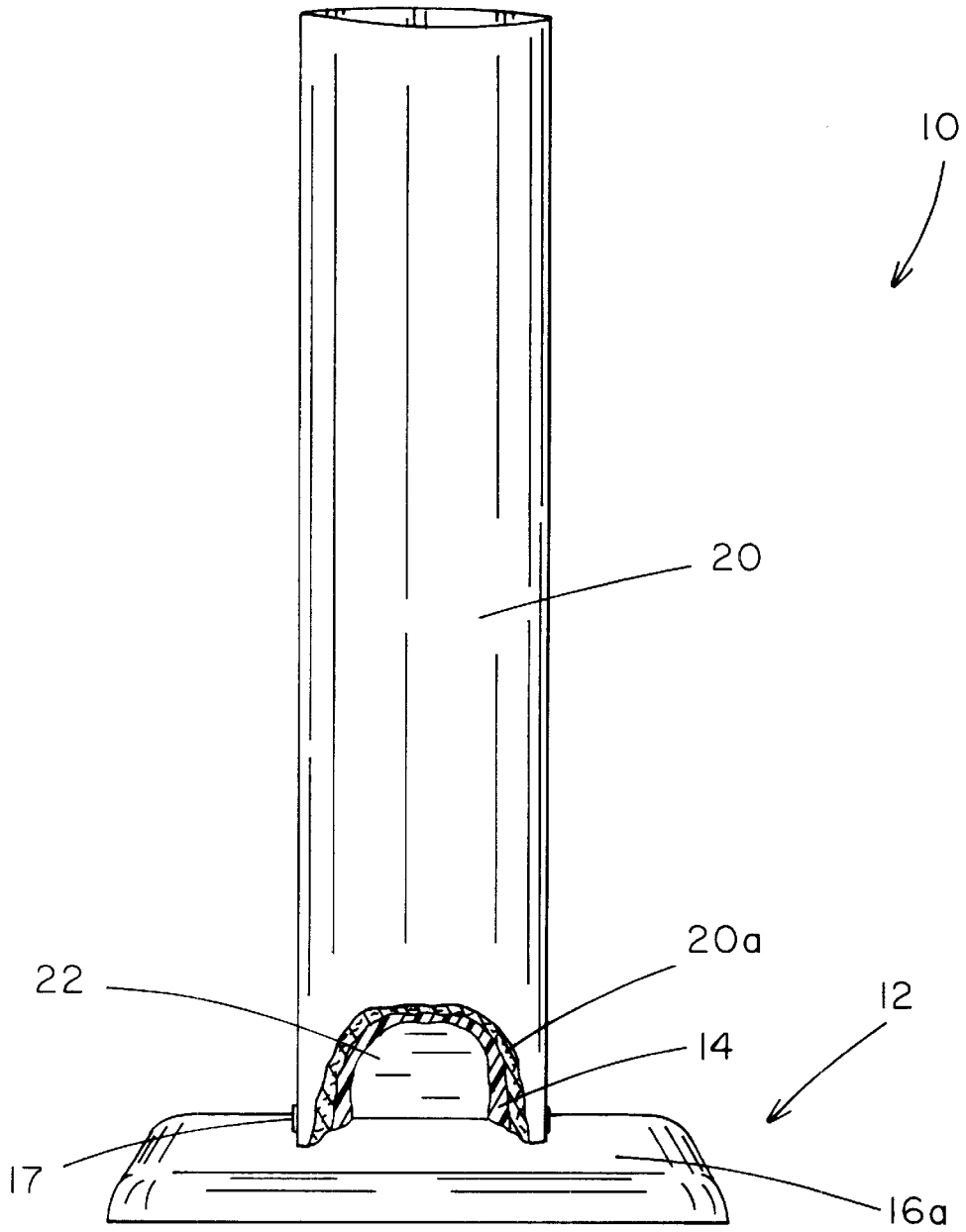
FIG. 2 is a perspective view of the entire device of FIG. 1, fully assembled, with a portion of the bottom of the tube and of the inner plug broken away to show the interior construction.

Referring to the drawings, and particularly to FIGS. 1 and 2, numeral 10 designates generally a fireworks stand constructed in accordance with the present invention and for use as a launching device for launching a variety of known aerial fireworks shells (not shown).

Stand 10 includes a base 12 as well as a launch tube 20, which is mountable to the base, and is shown in FIG. 1 in exploded perspective view, with tube 20 separated from, and positioned above, base 12.

As illustrated in FIG. 1, base 12 has a lower portion 16 (which in the preferred embodiment shown is plate-like, but is not necessarily so flat) and a protrusion 14, which extends upwardly from plate 16 approximately centrally from one substantially flat side thereof when stand is in use position as shown. Plate 16 has an upper surface 16*a* and a lower surface 16*b*(shown in FIG. 3) and is preferably (although not necessarily) generally rectangular and has dimensions sufficient to support launch tube 20 in a stable, upright manner for use in launching a shell.

In the preferred embodiment, wherein launch tube 20 is about 16 inches in length, base 12 is substantially square in shape and has dimensions of approximately 5 ¾ inches by 5 ¾ inches. Base 12 is formed of a very heat-resistant material, and structured of sufficient thickness and durometer strength, so as to be capable of repetitive use without being readily destroyed, and without resulting in a less than satisfactory aerial display due to the loss of force available to propel a normal fireworks shell. Corners 26 are preferably rounded so as to avoid sharp edges or points for convenience and safety in storing and handling the device, but may be constructed in any manner that allows the base to serve the function of stably supporting launch tube 20.

Protrusion 14 has an outer perimeter sized and shaped substantially to match the internal side wall 20*a* of launch tube 20, and lower plate portion 16. An annular ridge 18 that extends radially from at least a portion of, and preferably the entire, exterior side wall or perimeter of protrusion 14 provides a press fit seal against the interior wall of launch tube 20. A top surface 15 of protrusion 14 is preferably substantially flat, as shown but may alternatively be concave or convex if appropriate for the particular shell to be launched. Protrusion 14 is preferably about 1 ½ inches in length, however varied lengths may be utilized to perform the important support and sealing connect functions of protrusion 14, depending on the size of tube 20.

FIG. 2 depicts the entire fireworks launching device 10, with launch tube 20 attached in normal use position to protrusion 14 of base 12. Protrusion 14 is shown partially cut away to illustrate crossbars 22 preferably (but not necessarily as shown) formed within the hollow interior of protrusion 14 in order to reinforce the structure. Crossbars 22 preferably intersect at approximately 90 degree angles, as shown in FIG. 3, but it is recognized that alternative structural arrangements may be used to reinforce the interior of protrusion 14.

Figure 3:
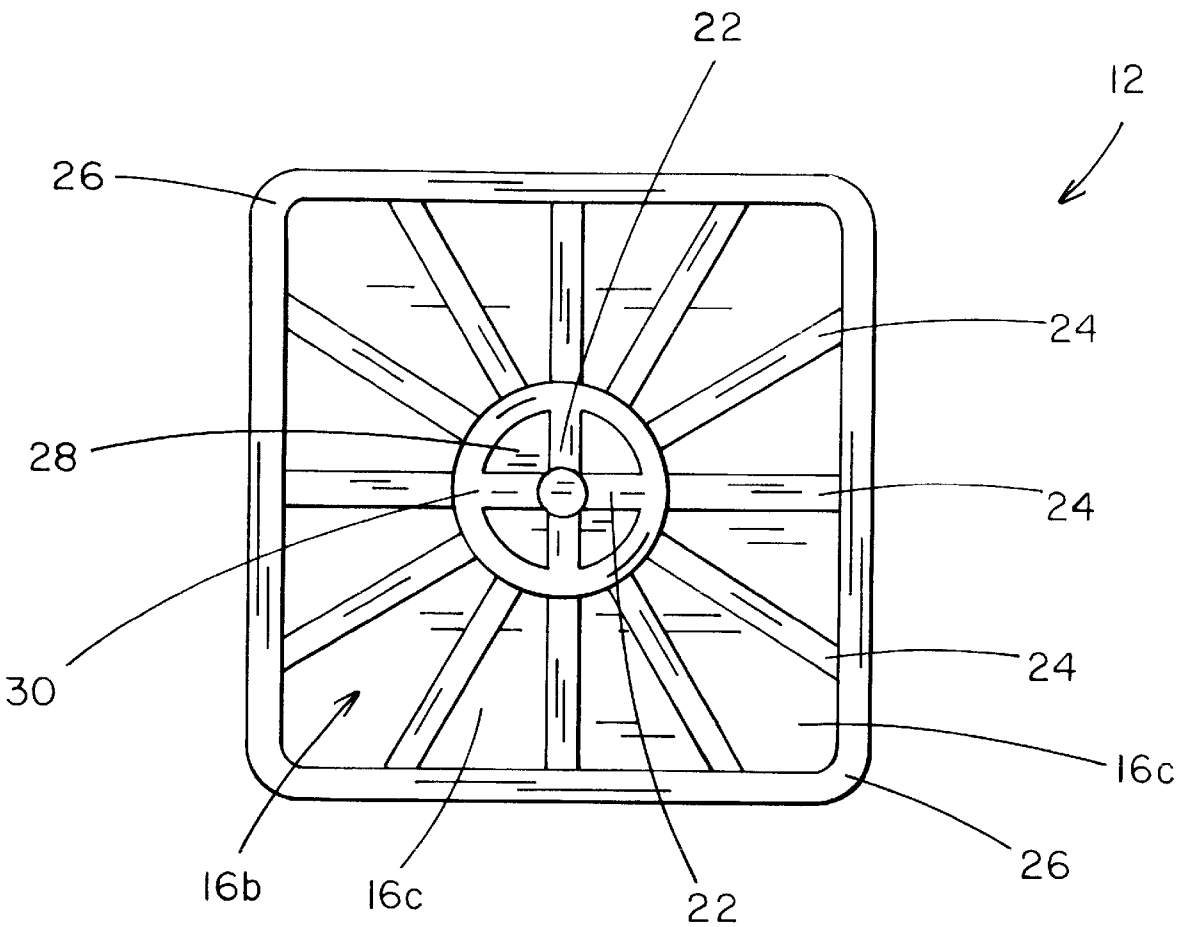
FIG. 3 is a bottom plan view of the base of the stand of FIG. 1.

The underside 30 and hollow interior 28 of protrusion 14 is visible in FIG. 3, as are crossbars 22 that serve to reinforce the structure. Radial ribs 24 of the preferred embodiment define characteristic cutout or hollow sections 16*c* that are circumscribed by the ribs. Cutout sections 16*c* allow base 12 to "grip" a surface upon which it rests, and render the base 12 light weight and less expensive to manufacture.

Launch tube 20 is a unitary tubular member having a length greater than its diameter and having an internal diameter that is sized and shaped appropriately to receive fireworks shells of known and readily available varieties. Launch tube 20 has an unbroken, preferably cylindrical, sidewall with an interior diameter and shape so as to fit snugly and grippingly onto protrusion 14 of base 12. Launch tube 20 may be (but is not required to be) fastened to protrusion 14 of base 12 by means of staples, such as those indicated, for example at 17 in FIGS. 1 and 2 (or by other suitable fasteners or fastening means, such as a detenting bump and groove arrangement), in order to enhance the connection to protrusion 14.

In the preferred embodiment, launch tube 20 is constructed of cardboard having a thickness of approximately ¼ inch and a length of about 16 inches. Tube 20 can also constructed of any heat resistant material such as plastic or rubber. The internal diameter of launch tube 20 is preferably about two inches, but may vary in keeping with requirements for the size of the shell to be launched therefrom. The dimensions given are preferred, but alterations that do not effect the usefulness of the device are also possible.

When constructed as described and shown, the new fireworks stand is an extremely stable and strong launching device for aerial shells, which launching device can be used repeatedly, for example, at least ten or twelve times, without deteriorating to such an extent that it is unstable or unsafe for use. The described structure has met a long-felt need in the marketplace, as it is inexpensive and facile to manufacture and can be used easily by anyone with even minimal experience in the proper use of aerial, shell-type fireworks.

In view of the foregoing, it will be seen that the several objects of the invention are achieved and other advantages are attained. Although the foregoing includes a description of the best mode contemplated for carrying out the invention, various modifications are conceivable.

As various modifications could be made in the constructions and methods herein described and illustrated without departing from the scope of the invention, it is intended that all matter contained in the foregoing description or shown in the accompanying drawings shall be interpreted as illustrative rather than limiting.

What is claimed is:

1. A launching device for launching multiple aerial fireworks in succession from said launching device comprising:

a tubular member having a wall defining an internal perimeter sized and shaped to receive conventional aerial fireworks shells; and a unitary base mountable to said tubular member to thereby support the tubular member in an upright use position on a support surface, said base including:

a lower portion of appropriate size and shape to support said tubular member in a stable upright position; and a protrusion extending from said lower portion, said protrusion having an outer perimeter corresponding in size and shape to the inner perimeter of said tubular member to thereby permit snug insertion and an airtight seal of the protrusion into said tubular member to secure said tubular member to said base.

2. The device of claim 1, wherein the protrusion of said base has an annular ridge extending radially from the perimeter of said protrusion to a sufficient extent to provide a firm press fit of the protrusion with the interior of said tubular member, thereby forming a seal around the interior wall of the tubular member and further securing said tubular member to the base.

3. The device of claim 1, wherein the base is constructed of heat resistant material.

4. The device of claim 1, wherein the tubular member is constructed of cardboard.

5. The device of claim 1, wherein the tubular member is constructed of a plastic material.

6. The device of claim 1, wherein the tubular member is connected by at least one fastener to the base.

7. The device of claim 1, wherein the tubular member is approximately sixteen inches long and has an internal diameter of approximately two inches, and the wall is approximately one quarter of an inch thick.

8. The device of claim 1, wherein the lower portion of the base has an underside with a plurality of ribs circumscribing cutout areas to thereby decrease the weight of the base and to provide greater traction when the base is placed against a substantially flat support surface.

9. The device of claim 1, wherein the protrusion of the base has an underside having a plurality of radially extending ribs.

10. The device of claim 1, wherein the underside of the lower portion of the base has a plurality of ribs extending radially outwardly from the wall of the protrusion of the base to the edge of the lower portion of the base.

11. The device of claim 1, wherein the protrusion includes internal dividing portions defining openings to thereby lighten without significantly weakening the base.

12. The device of claim 1, wherein the lower portion of the base is rectangular in shape.

13. The device of claim 1, wherein the protrusion extends approximately one and one-half inches from an upper surface of the lower portion of the base.

14. The device of claim 1, wherein the tubular member has a first end and a second end and a continuous uninterrupted wall of uniform shape extending from the first end to the second end.

15. The device of claim 1, wherein the tubular member is cylindrical.

16. The device of claim 1, wherein the protrusion of the base is cylindrical.

17. The device of claim 3, wherein the base is formed of rubber.

18. The device of claim 7, wherein the lower portion of the base is generally planar and has dimensions of about five and three-quarter inches by five and three-quarter inches.

19. The device of claim 1, wherein said base is formed as a single unitary piece with said protrusion being integral with the lower portion of said base.

20. In a fireworks launching device having an elongate tubular member and a base portion, a base comprising:

a lower portion of sufficient width and depth to support said tubular member in a stable upright position; and a protrusion extending from said lower portion, the protrusion having an outer perimeter equal to an inner perimeter of the tubular member such that it is able to insert slidingly into the tubular member thereby securing said tubular member to said base in a snug fit and airtight seal.

* * * * *